US005329678A

United States Patent [19]

Bagnasco

[11] Patent Number: 5,329,678

[45] Date of Patent: Jul. 19, 1994

[54] MOLDED SAFETY PIN

[76] Inventor: Dante V. Bagnasco, 70 Harbor Hills Dr., Port Washington, N.Y. 11050

[21] Appl. No.: 123,736

[22] Filed: Sep. 20, 1993

[51] Int. Cl.[5] ..... A44B 9/00

[52] U.S. Cl. ..... 24/709.4; 24/708.9; 24/709.9

[58] Field of Search ..... 24/709.4, 709.5, 709.6, 24/709.7, 709.2, 709.3, 706.2, 706.7, 707, 707.6, 707.9, 708.2, 708.7, 708.9, 710, 711.4, 711.5, 709.9, 710.3

[56] References Cited

U.S. PATENT DOCUMENTS

| | | | |
|---|---|---|---|
| 2,555,666 | 6/1951 | Young | 24/709.2 |
| 2,760,247 | 8/1956 | Bagnasco | 24/708.7 |
| 3,018,533 | 1/1962 | Bagnasco | 24/708.9 |
| 3,744,099 | 7/1973 | McCoy | 24/708.9 |
| 3,883,930 | 5/1975 | Bagnasco | 24/708.9 |
| 4,071,927 | 2/1978 | Bagnasco | 24/709.9 |

*Primary Examiner*—Victor N. Sakran
*Attorney, Agent, or Firm*—W. Patrick Quast

[57] ABSTRACT

A molded safety pin having an elongated base portion with extensions at both ends is described. At the first extension a hinged connection provides the means for biasing the pin portion at the juncture of the means for anchoring the pin and the base portion. At the second extension a detent structure provides the means for holding the pin portion securely when the safety pin is in a closed position while permitting convenient manual release of the pin when required.

Additionally a simplified injection mold for fabricating the safety pin is described.

8 Claims, 2 Drawing Sheets

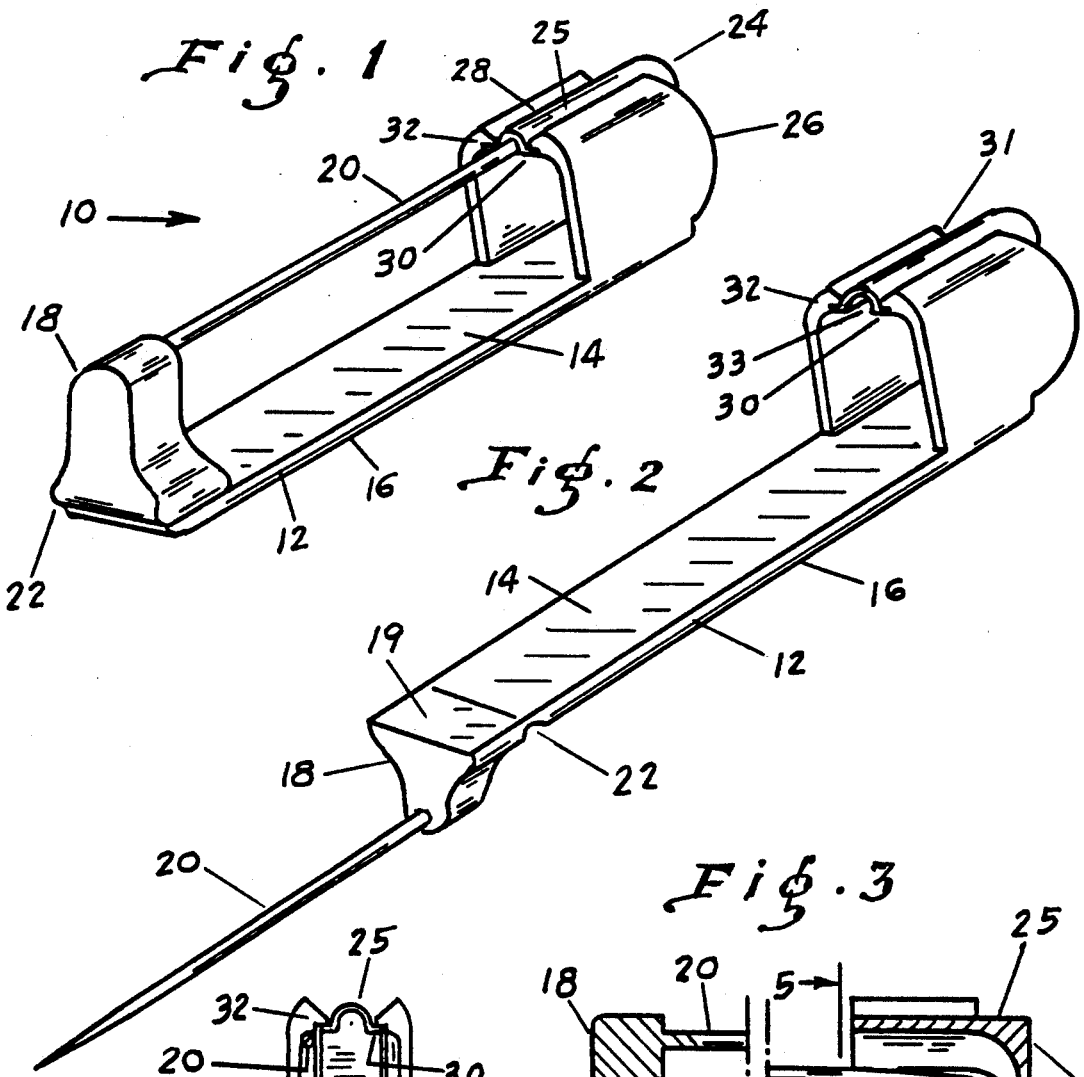
Fig. 1
10
18
20
22
12
14
16
24
25
26
28
30
32
Fig. 2
31
32
33
30
14
16
12
19
18
22
20
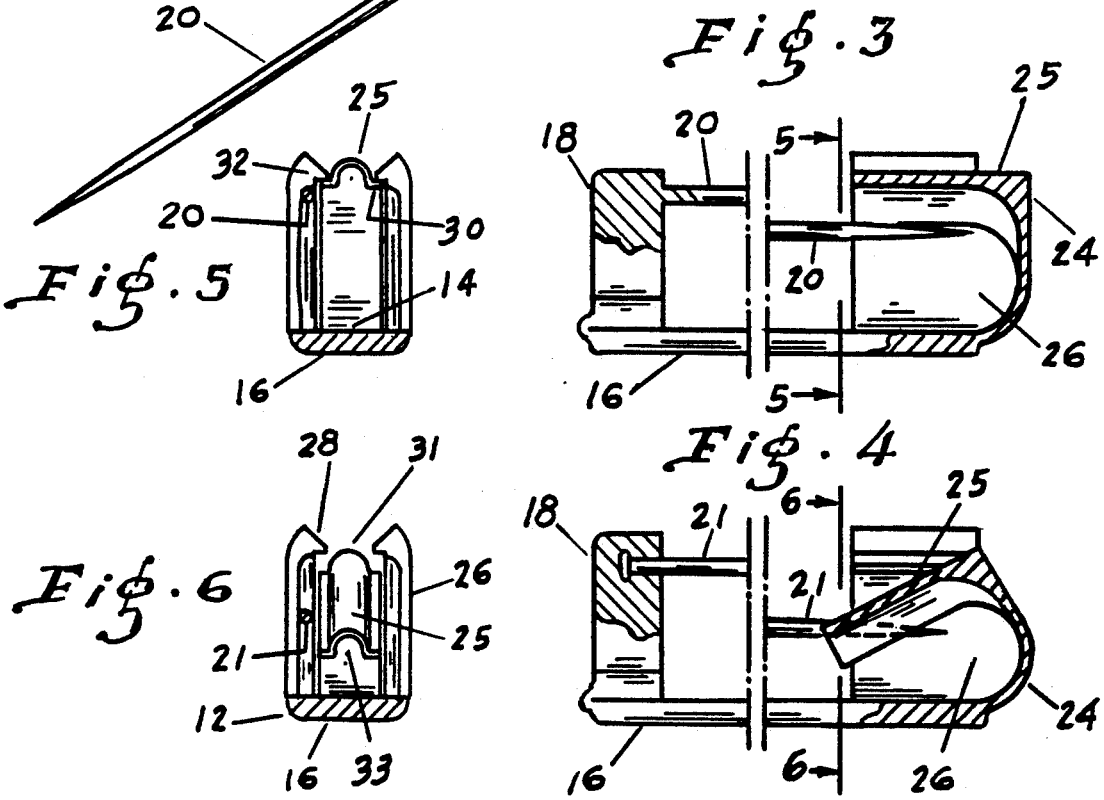
Fig. 3
18
20
5
25
24
20
26
16
5
Fig. 5
25
32
20
30
14
16
Fig. 4
18
21
6
25
21
24
16
6
26
Fig. 6
28
31
26
25
21
12
16
33

MOLDED SAFETY PIN

BACKGROUND

This invention relates to safety pins of the positive locking type, wherein the piercing end of the biased pin shaft is manually depressed from its open position and moved into a restraining or locking detent, and wherein the pin can be subsequently released only by a joint manipulation of the pin shaft and locking detent. Safety pins of this character are disclosed in my U.S. Pat. Nos. 2,546,669, 2,760,247, 3,018,533, 3,883,930, and 4,071,927. The instant invention is concerned with improvements on my patents, and is particularly directed to an improved safety pin of inexpensive molded construction.

It is therefore a principal object of the invention to provide a molded safety pin of the character described above that can be mass produced inexpensively.

A further object of this invention is to provide a safety pin of the character described above that can be molded in a simplified plastic injection mold.

Another object of the invention is to provide a safety pin of the character described above wherein a hinged section provided the means for biasing the pin shaft.

Still another object of this invention is to provide a safety pin of the character described above having additional convenience in both pin insertion and pin release.

An additional object of this invention is to provide a safety pin of the character described wherein the pin shaft can be fabricated in either plastic or metal.

SUMMARY

These and other objects are obtained by the molded safety pin of the instant invention. In one version of the invention the safety pin is molded in its entirety out of a suitable resilient and strong plastic material, such as, for example, polypropylene. The safety pin is comprised of an elongated planar base portion having an upper surface and a lower surface, with extentions at both ends of the base. At one end of the base the pin portion of the safety pin is anchored to a first extension. This first extension has a top surface substantially co-planar with the upper surface of the base portion when the safety pin is in fully open position. The top, co-planar surface of the first extension is connected by a hinge to the base portion, the hinge in this version consisting of a channel across the width of the lower surface of the junction between the first extension and the base portion, making this area of the juncture substantially thinner than the base portion. A central portion of the first extension is thicker then the base portion, and a part of this extension is therefore normally perpendicular to and below the upper surface of the base when the hinged connection is open. In this position the pin portion of the safety pin extends longitudinally away from the base portion and the end of the first extention.

At the opposite end of the base portion a second extention is in the form of a "U" shape so as to bow in a reverse direction toward the base. The free end of the "U" is formed as a detent which restrains the piercing end of the pin portion of the safety pin when it is forced beneath the detent into closed position. The molded base portion also has comparatively rigid lateral extensions or wings that form an arch like pin guide overhanging the detent extension. To close the safety pin the pin portion is moved upward and over the upper surface of the base portion substantially through a 180 degree arc, into a slot between the wings of the arch like pin guide, and is pressed beneath and secured by the detent.

In a second version of the invention a portion of the arch like pin guide completely overhangs the detent to further reinforce the structure in this part of the safety pin.

In another version of the invention, a metal pin portion is molded into the safety pin in place of the plastic pin portion of the safety pin described above.

BRIEF DESCRIPTION OF THE DRAWINGS

FIG. 1 is a perspective view of the molded safety pin of the invention showing the closed position thereof.

FIG. 2 is a perspective view of the molded safety pin of the invention showing the fully open position thereof.

FIG. 3 is a longitudinal sectional view partly broken away, of the safety pin of FIG. 1 in an initial stage of opening.

FIG. 4 is a longitudinal sectional view similar to FIG. 3, showing the metal pin portion of the safety pin in a second stage of opening.

FIG. 5 is a transverse sectional view taken along the line 5—5 of FIG. 3.

FIG. 6 is a transverse sectional view taken along the line 6—6 of FIG. 4.

DETAILED DESCRIPTION

Figure 7:
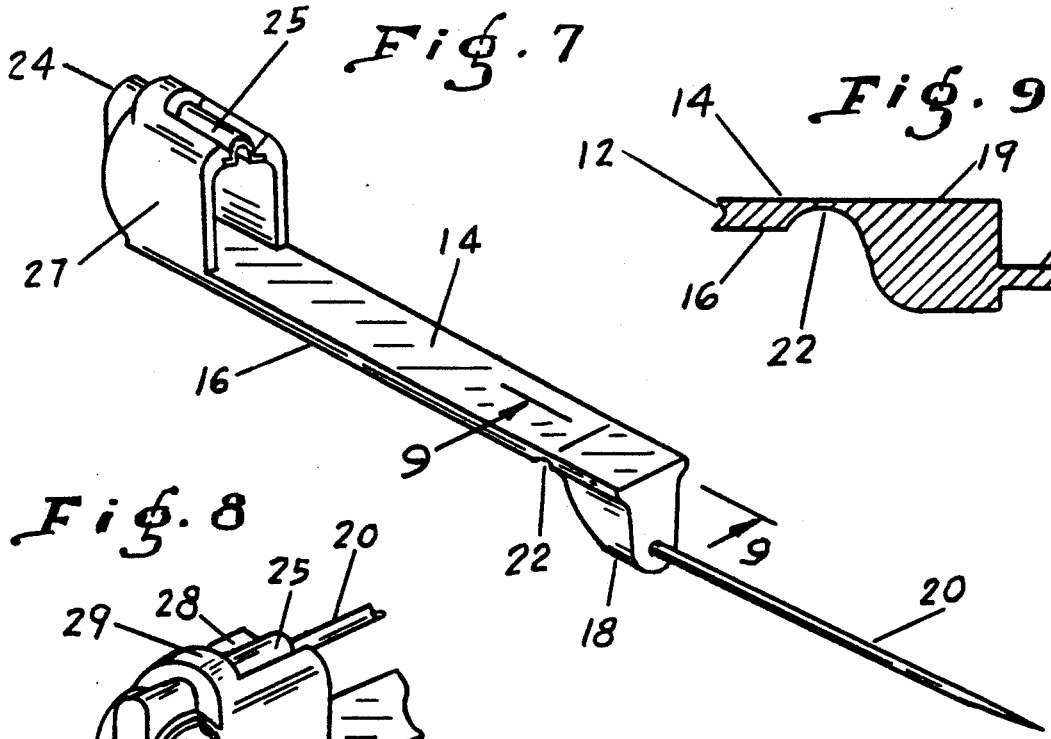
FIG. 7 is a perspective view of a second version of the molded safety pin of the invention.

Referring now to FIGS. 1 and 2 a version of the molded safety pin 10 of the invention is shown in both a normally closed position (FIG. 1) and a normally open position (FIG. 2). The safety pin consists essentially of four sections; a base portion 12; a first extension 18 at one end of the base portion; a second extension 24 at the other end of the base portion; and a pin portion 20 anchored to the first extension. In this version the safety pin 10 is molded entirely out of a suitable plastic such as polypropylene. The plastic needs to be strong but also resilient so as to permit frequent closing and opening of the safety pin as may be required.

The elongated, planar base portion 12 has an upper surface 14 and a lower surface 16. At one end of the base portion the second extension 24 is a "U" shape 25 so as to bow in a reverse direction toward the base. The free end 33 of this "U" is formed as a detent which restrains the piercing end of the pin portion 20 of the safety pin when it is forced beneath the detent (FIG. 1) into closed position. Rigid lateral extensions 26 or wings form an arch like pin guide overhanging the detent extension. A slot 31 runs the full length of the top surface of the overhanging pin guide so as to permit insertion and release of the pin portion 20 as required. To facilitate insertion of the pin portion into the pin guide the pin guide slot 31 has an oblique slope 28 at either side of the slot angling away from the upper surface 25 of that portion of the detent overhanging the base portion of the safety pin.

Figure 9:
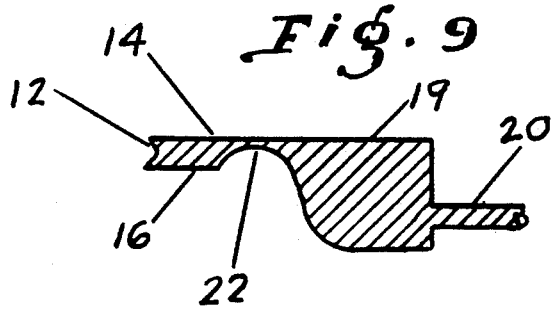
FIG. 9 is a side sectional view of the hinge connection between the first extension and the base portion of the molded safety pin.

At the other end of the base portion the first extension provides the means for anchoring the pin portion 20 of the safety pin and biasing the pin portion for insertion and release from the detent. In a normally open position (FIG. 2) this first extension has a flat surface 19 essentially co-planar with the top surface 14 of the base portion. At the juncture of the base portion and the first extension a channel 22 best seen in FIG. 9 runs laterally across the width of the lower surface 16 of the base. This channel 22 serves to provide a weakened line between the base portion and the first extension. The first extension 18 is substantially thicker than the base portion with a part of this first extension extending perpendicular to, and below the lower surface 16 of the base portion 12. Pin portion 20 is anchored at the end of this first extension (and is indeed an integral portion of the safety pin when molded according to the injection mold of FIG. 10), extending longitudinally away from the end of the first extension and the base portion when the safety pin is in a fully open position (FIGS. 2 and 7).

To close the pin the pin portion is pressed over the base portion until the piercing end of the pin contacts the slot 31 within the pin guide 26 overhanging the detent 24. At this point the flat surface 19 on the first extension is in contact with the upper surface 14 of the base portion with the weakened hinge section defined by channel 22 providing the means for biasing the first extension. The pin portion is then pressed downward into the pin guide slot 31 and applying sufficient additional pressure to force the detent downward to form a space between the detent and the pin guide. As continued pressure is applied to the pin, it is cammed into this space by the detent, either to one side or the other, so as to ride downward along one of the pin guide lips 32 until it passes the flat, laterally extending portion 30 of the detent. At this point the detent snaps back to its original position with detent lateral extension 30 now contacting lip portion 32 of the pin guide 26. The pin is now released, and under its own bias it moves upward into the concave 25 portion of the detent (FIG. 1), where it is effectively locked in closed position against accidental release.

The pin opening operation requires two separate manipulations, thereby precluding for all practical purposes accidental opening. The pin portion 20 is manually depressed and pushed laterally until it clears the laterally extending portion 30 of the detent, as shown in FIGS. 3-6. The detent 24 is also lowered to a point below the pin portion (FIGS. 3 and 4) by manual pressure on this second flexible extension. As best shown in FIG. 6 the pin portion is now free under bias of the resilient first extension 18 to move upward and through the slot 31 to open position.

As previously described the pin portion 20 may be an integral part of the safety pin (FIG. 3), being made out of the same plastic material as the other portions of the safety pin, or the pin portion can be a metal pin 21 (FIG. 4) as will be further discussed in the molding process. It should be noted that while the pin portion 20 and first extension 18 are normally in linear alignment with the base portion 12 when the safety pin is in fully open position this linear alignment is not essential to the proper functioning of the safety pin of the invention. For example, the hinge connection between the first extension and the base portion can be arranged so as to cause the pin portion to be out of linear alignment with the base portion, said pin portion being held either somewhat above or somewhat below the upper surface 14 of the base portion.

Figure 8:
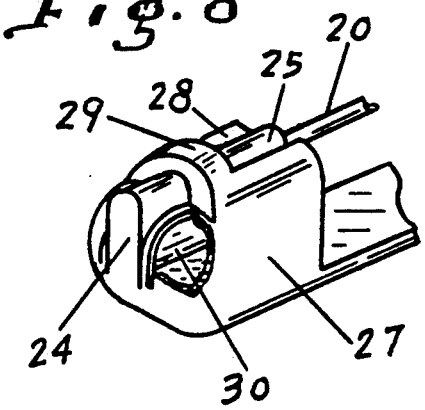
FIG. 8 is a sectional view, partly broken away, of the second version of the pin guide of the safety pin of the invention, showing the detent lateral extension.

FIGS. 7 and 8 illustrate a second version of the pin guide for the safety pin. In this version a portion 29 of the pin guide 27 completely overhangs a portion of the detent 25 that extends over the upper surface of the base portion. This serves to further strengthen this section of the safety pin of the invention.

Figure 10:
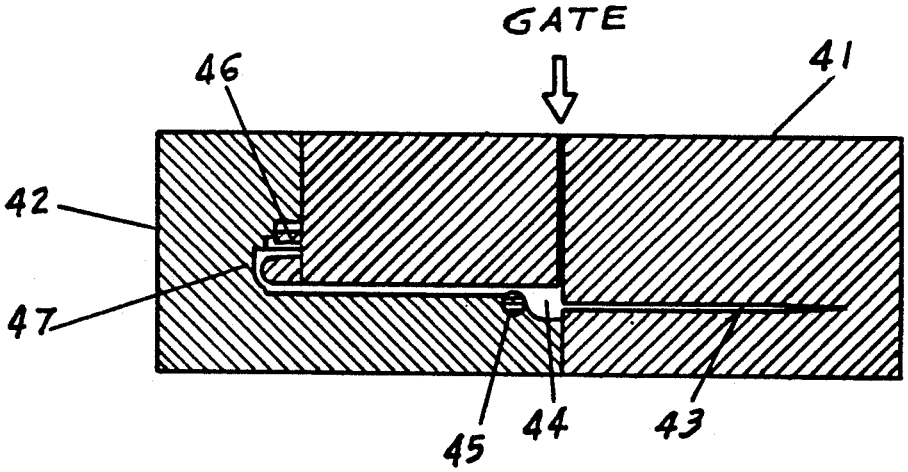
FIG. 10 is a sectional view of an assembled single cavity mold for making the molded safety pin of FIG. 1.
Figure 11:
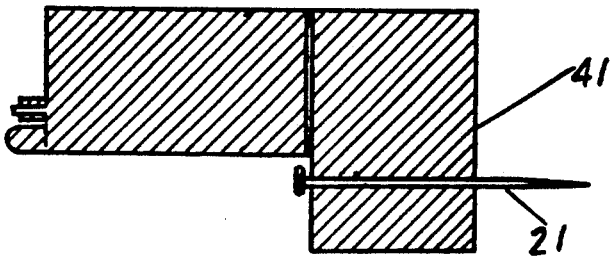
FIG. 11 is one portion of the mold illustrating making the molded safety pin with a metal pin portion in place of a plastic pin portion.

FIGS. 10 and 11 illustrate a single cavity injection mold 40 of simplified design that can be employed to fabricate the safety pin of the invention. The mold is divided into two section, Section A (41), and Section B (42) with a gate between the two sections. Section A remains stationary at all times and contains a cavity 43 for either forming a plastic pin portion, or for the insertion of a metal pin 21 prior to the injection molding procedure. FIG. 11 illustrates the insertion of a metal pin portion 21 prior to the molding procedure. Section B contains cavity 44 for forming the base portion and the first extension, a cavity 47 for forming the second or detent extension, and a cavity 46 for forming the pin guide. A round rod 45 forms the channel 22 between the base portion and the first extension. When the round rod 45 is withdrawn, this permits the removal of the cast pin portion from the mold when this section (Section B) separates from Section A after the molding process. It will be apparent that the mold and ejection technique can be varied as preferred according to the state of the art.

While versions of the present invention have been shown and described in detail, various modifications and improvements thereon will become readily apparent to those skilled in the art. Accordingly, the spirit and scope of the present invention is to be limited only by the following claims.

What is claimed is:

1. A molded safety pin of the character described, comprising:

(a) a base portion being elongated in length relative to the width of the base portion, the base portion having an upper surface and a lower surface;

(b) a first extension at one end of the base portion;

(c) means for providing a hinged connection between the first extension and the base portion;

(d) the first extension being thicker than the base portion, with a part of the first extension being normally below the lower surface of the base portion when the safety pin is in an open position;

(e) the first extension having a pin portion anchored therein, the pin portion extending substantially in a linear direction away from the first extension and the base portion when the safety pin is in an open position;

(f) the pin portion being readily biased back over the upper surface of the base portion by means of the hinged connection between the first extension and the base portion;

(g) a second extension comprising a detent extending in a reverse loop from the opposite end of the base portion for retaining the pin portion in a closed position when the pin portion is moved beneath the detent;

(h) the base portion also including as a molded part thereof a wing-like pin guiding structure extending transversely from the upper surface of the base portion at opposite sides of the detent to partly enclose and overlie the detent.

2. A safety pin according to claim 1 wherein the hinged connection is an integrally molded portion of the safety pin comprising a channel across the width of the base portion in the lower surface of the base portion at a juncture between the base portion and the first extension, the channel forming a weakened area at the juncture so that the pin portion can be readily biased back over the base portion.

3. A safety pin according to claim 1 wherein the wing-like pin guiding structure further comprises a pin guiding slot, the slot having walls at either side of the slot sloping obliquely away from the detent in order to facilitate the insertion of the pin portion within the slot.

4. A safety pin according to claim 1 wherein the detent further comprises flat, laterally extending side walls which contact the pin guiding structure.

5. A safety pin according to claim 1 wherein a portion of the wing-like pin guiding structure completely overlies the detent.

6. A safety pin according to claim 1 wherein the safety pin is substantially molded in a suitable plastic.

7. A safety pin according to claim 6 wherein the pin portion is fabricated in plastic.

8. A safety pin according to claim 6 wherein the pin portion is fabricated in metal.

* * * * *